United States Patent [19]

Watanabe

[11] 4,370,990

[45] Feb. 1, 1983

[54] COIN COUNTING AND STOPPING APPARATUS FOR USE IN A COIN HANDLING MACHINE

[75] Inventor: Kenkichi Watanabe, Tokyo, Japan

[73] Assignee: Laurel Bank Machine Co., Ltd., Tokyo, Japan

[21] Appl. No.: 163,284

[22] Filed: Jun. 26, 1980

[30] Foreign Application Priority Data

Jun. 29, 1979 [JP] Japan ..... 54/89179[U]
Nov. 13, 1979 [JP] Japan ..... 54/146948
Dec. 25, 1979 [JP] Japan ..... 54/179750[U]

[51] Int. Cl.[3] ..... G07D 9/00
[52] U.S. Cl. ..... 133/8 A; 133/1 A
[58] Field of Search ..... 133/1 A, 8 A, 8 R, 3 B, 133/3 C, 3 D, 3 E, 3 G, 8 B, 8 C; 53/212, 501; 193/32, 40, DIG. 1; 221/206, 251, 7; 198/532; 235/92 CN

[56] References Cited

U.S. PATENT DOCUMENTS 2,594,423 4/1952 Gordon ..... 133/8 R X
3,565,085 2/1971 Heywood et al. ..... 133/8 R
3,682,353 8/1972 Roast ..... 133/3 G X
3,788,029 1/1974 Pokorney ..... 53/501
3,978,873 9/1976 Gross ..... 133/8 A
4,041,280 8/1977 Ohsako et al. ..... 133/8 R X
4,071,998 2/1978 Meadows ..... 53/501
4,216,788 8/1980 Watanabe et al. ..... 133/8 R
4,230,136 10/1980 Heinrichs ..... 133/8 R X

FOREIGN PATENT DOCUMENTS 2705020 8/1978 Fed. Rep. of Germany ..... 133/8 R

*Primary Examiner*—Robert B. Reeves
*Assistant Examiner*—Edward M. Wacyra
*Attorney, Agent, or Firm*—Fleit & Jacobson

[57] ABSTRACT

For a coin handling machine, there is provided a coin counting and stopping apparatus wherein coins which are transferred in a coin path are counted one after another and stopped when the number of the counted coins reaches a preset number. The apparatus includes at least one detecter or preferably two detecters disposed in the coin path for detecting the passage of the coins to generate signals. An electric circuit which receives signals generated by one or two detecters performs a counting operation for the number of the coins which have passed by the detecters. A stopper is provided downstream of the detecters. When the number of the counted coins reaches a preset number, the stopper is rotated to stop the subsequent coins.

6 Claims, 16 Drawing Figures

COIN COUNTING AND STOPPING APPARATUS FOR USE IN A COIN HANDLING MACHINE

BACKGROUND OF THE INVENTION

This invention relates to a coin counting and stopping apparatus for use in a coin handling machine such as a coin counting machine, a coin sorting machine, a coin packaging machine, etc. More particularly, the invention relates to a coin counting and stopping apparatus for use in a coin handling machine in which coins transferred in a coin path are counted, and when a preset number of coins is counted, the subsequent coins are stopped.

In conventional coin handling machines, a counter operatively associated with a star wheel has been used to count coins. The star wheel has teeth and the configuration of each tooth accommodates with the peripheral curved surface of coin. The coins are counted each time when the star wheel is angularly rotated per its one tooth by one coin. However, the above-mentioned counting system has a disadvantage that in case where a counting operation is performed at a high speed, when the star wheel is stopped in response to a count end signal, the star wheel is liable to be rotated further due to its great inertia force and is not stopped in a predetermined position, and thereby making a surplus count or a malfunction.

In another conventional coin handling machine, a counting operation is performed by the provisions of a roller which is engaged with the coins each time when the coins pass by. However, in these machines, since the roller is integral with massive arms actuated by an electromagnet so as to stop the coins, there is also a disadvantage that a stopping operation is not rapidly performed due to the great inertia mass of the stopper including the roller and the arms.

In addition to the above-mentioned machines, with regard to the coin stopper, there have been proposed other systems. In one conventional stopper system, the coins are stopped by a stopper rod which is caused to project into the coin path from one side thereof and in another stopper system, the coins are stopped by a stopper rod which is caused to project upwardly into the coin path from its bottom thereof.

In the former system, the stopper rod is caused to project into a generally triangular space defined by a guide plate and two portions of peripheral surfaces of two adjacent coins within the coin path. Since the triangular space is relatively large, a timing for actuating the stopper rod can be set within a relatively wide period. However, since the coins are forced to be moved by the transfer belt at a high speed, when the coins are stopped, a shock or a reaction is applied to the stopper rod and/or the subsequent coins, so that the coins thus stopped would overlap. In order to make a stopper rod to endure the shock, the stopper rod must be made large and rigid. In such a case, the power for actuating the stopper rod must also be great. Therefore, there are disadvantages that the whole stopping mechanism should be constructed to have a relatively great mechanical strength and the mechanism itself becomes complicated.

In the latter system, a position where the stopper rod is projected up must be set near the engaging point of two adjacent coins in order to obtain an accuracy of stopping. In such a case, a timing for projecting the stopper rod must be made precisely. If the stopper rod is projected up out of timing, guide plates forming the coin path would be greatly pushed through the coins, or the coin would be pushed up and thereby raise the transfer belt. Consequently, the coin thus pushed up, but not counted would be forced to be transferred by the transfer belt, and thereby causing no counted coin to pass by the counter.

SUMMARY OF THE INVENTION

It is, therefore, a main object of the invention to provide a novel coin counting and stopping apparatus for use in a coin handling machine which overcomes the above-mentioned disadvantages.

It is another object of the invention to provide a coin counting and stopping apparatus including a stopper which is simple in construction and easy to be operated very quickly.

It is a further object of the invention to provide a coin counting and stopping apparatus including a counting device which counts coins without fail.

It is a further object of the present invention to provide a coin counting and stopping apparatus which does not make an incorrect count on restarting the coin handling machine.

According to the present invention, there is provided a coin counting and stopping apparatus for use in a coin handling machine wherein coins transferred in a coin path are counted one after another and stopped when a preset number of coins is counted, which comprises at least one detecter provided in the coin path for detecting the passage of the coins to generate signals, a stopper rotatably mounted downstream of said detecter and including a portion to be projected into the coin path so as to stop the coins when the stopper is rotated, and means for rotating the stopper when the signals indicate that the preset number of coins are counted.

BRIEF DESCRIPTION OF THE DRAWINGS

Other objects and advantages of the present invention will become apparent from the following descriptions made with reference to the accompanying drawings, in which.

DESCRIPTION OF THE PREFERRED EMBODIMENTS

Embodiments of the present invention will be now described in detail with reference to the accompanying drawing.

Figure 1:
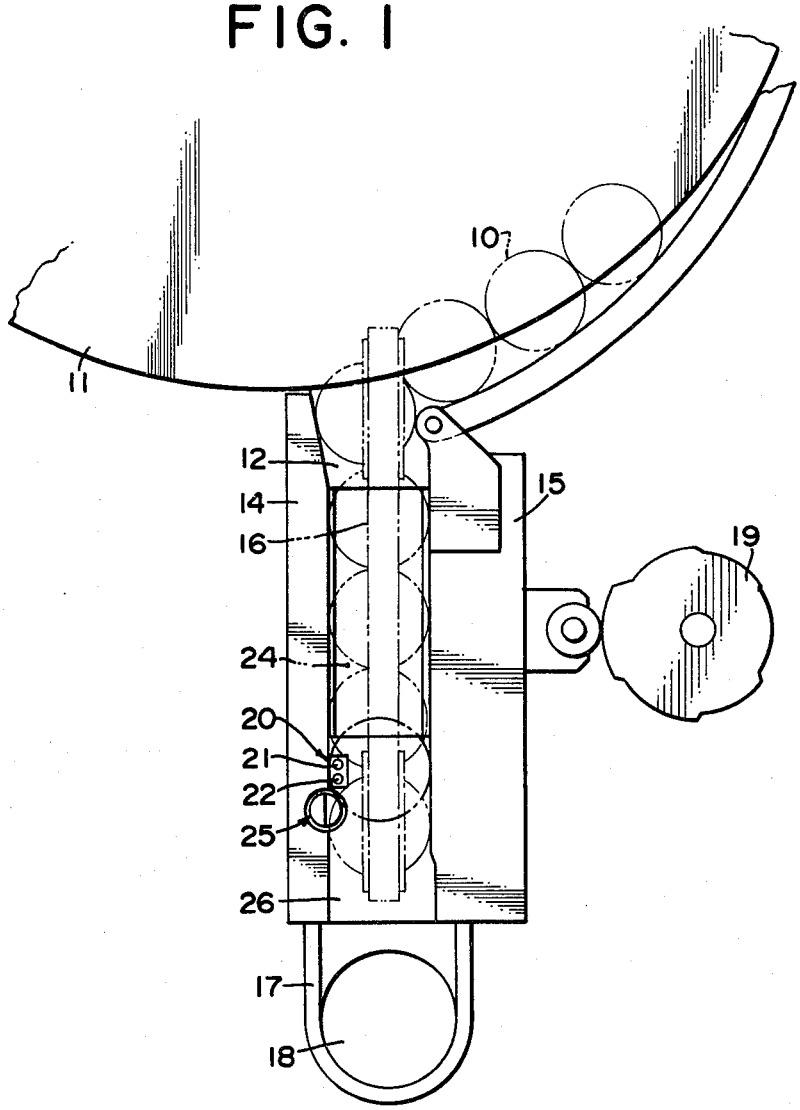
FIG. 1 is a top plan view showing a coin counting and stopping apparatus according to one embodiment of the invention.

In FIG. 1, there is shown a coin counting and stopping apparatus for use in a coin handling machine according to the present invention. Coins 10 supplied on a rotary disc 11 are received in a row into a coin path 12 defined by a fixed guide plate 14 and a movable guide plate 15 as the rotary disc 11 rotates. The coins 10 thus received are transferred in the coin path 12 at a high speed toward a chute 17 by a transfer belt 16 which press engages with the coins. Then, the coins enter the chute 17 and then are stacked in a stacking cylinder 18. A path width setting cam 19 is rotated by a coin kind setting dial, not shown, to move the movable guide plate 15 toward and away from the fixed guide plate 14 and thereby setting the width of the coin path 12 in accordance with the diameter of each kind of coins. A base plate 26 is mounted on the machine frame downstream of the coin path. Provided on the base plate 26 at the side of the fixed guide plate 14 are a coin counting device 20 and a coin stopper 25.

Figure 2:
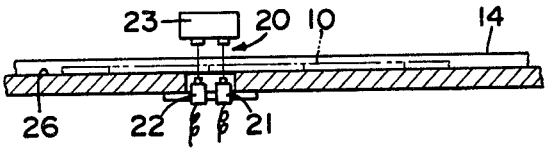
FIG. 2 is an enlarged cross-sectional side view showing a main portion of a coin counting device of the coin counting and stopping apparatus.

In one embodiment, the coin counting device 20 comprises two light sensitive elements or detectors 21 and 22, and a source of light 23 such as an LED (in FIG. 2). The detectors 21 and 22 are located so that they are concurrently included within a generally triangular space 24 which is defined by the inner surface of the fixed guide plate 14 and the peripheral portions of two adjacent coins when the coins are transferred in abutting relationship with each other, and so that one detecter is first blocked by a specific coin from light, and the other detecter is then blocked by the specific coin from light while the above-mentioned one detecter is first released from the block of the specific coin and then the other detecter mentioned above is released from the block of the specific coin. The above condition is usually established by arranging two detecters in very close positions and in parallel with the inner surface of the fixed guide plate 14, as shown in FIG. 1. It should be noted that, in this embodiment, two detecters 21 and 22 are located upstream of the stopper 25.

Although in the above embodiment, the detecter is constructed to be of a photoelectric counter type, the detecter may be made of a resilient spring type of contact piece which engages with the coins as the coins pass by.

Figure 3:
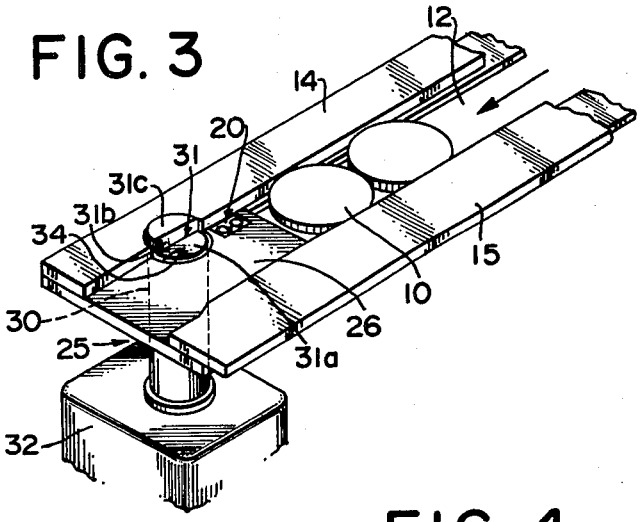
FIG. 3 is a perspective view showing the coin counting and stopping apparatus.

Referring now to FIG. 3, the coin stopper 25 comprises a stopping shaft 30 which projects upwardly through an opening 34 provided in the base plate 26 and the fixed guide plate 14 so that the axis of the shaft 30 is perpendicular to the base plate 26. The shaft 30 is formed with a semicircular cut-out 31. The horizontal surface **31*a* of the cut-out 31 is substantially flush with the upper surface of the base plate 26, and the vertical surface 31*b* of the cut-out 31 is in alignment with the inner surface of the fixed guide plate 14. The shaft 30 is connected to a rotary solenoid 32** to be driven in response to a count end signal which is described hereinafter in more detail.

Figure 4:
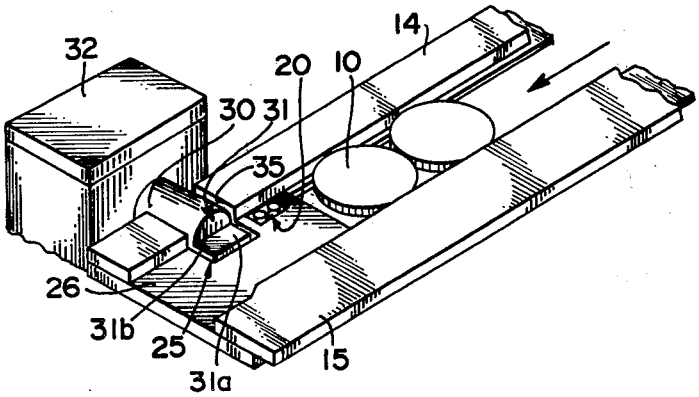
FIG. 4 is a perspective view showing a second embodiment of a stopper of the coin counting and stopping apparatus.

In FIG. 4, there is shown a second embodiment of the coin stopper 25. In the embodiment, the shaft 30 is mounted in a cut-out 35 formed in the fixed guide plate 14 and the base plate 26 so that the axis of the shaft 30 is in parallel to the base plate 26. The shaft 30 is formed with a semicircular cut-out 31 in a similar manner to the aforementioned first embodiment.

Figure 5:
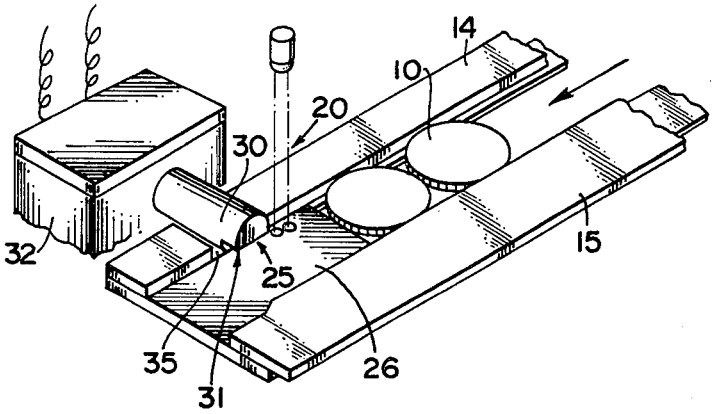
FIG. 5 is a perspective view showing a third embodiment of the stopper.

In FIG. 5, there is shown a third embodiment of the stopper 25. In the embodiment, the shaft 30 is similar to that of the second embodiment except that the cut-out 35 for accommodating the shaft 30 therein terminates at the inner surface of the fixed guide plate 14 and the cut-out 31 of the shaft 30 is located opposite to the upper surface of the base plate 26. In the embodiment, the coins 10 pass through the cut-out 31 between the base plate 26 and the top portion of the shaft 30.

Figure 6:
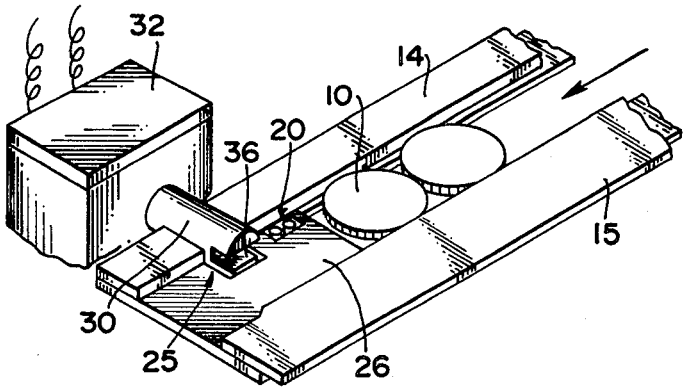
FIG. 6 is a perspective view showing a fourth embodiment of the stopper.

In FIG. 6, there is shown a fourth embodiment of the stopper 25 wherein the shaft 30 is formed with a groove 36 through which the coins 10 pass.

Figure 8:
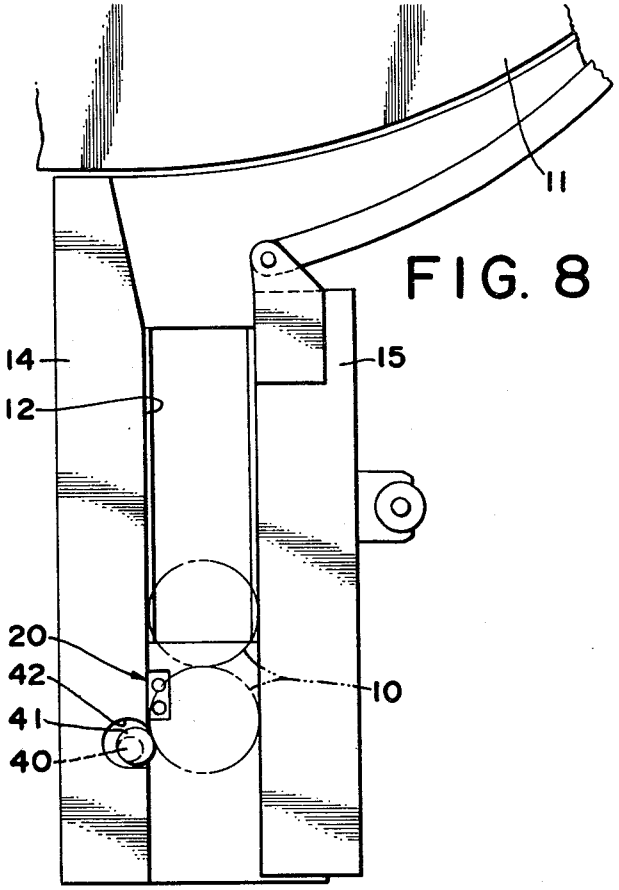
FIG. 8 is a top plan view showing the stopper of FIG. 7 with the stopper being rotated.
Figure 7:
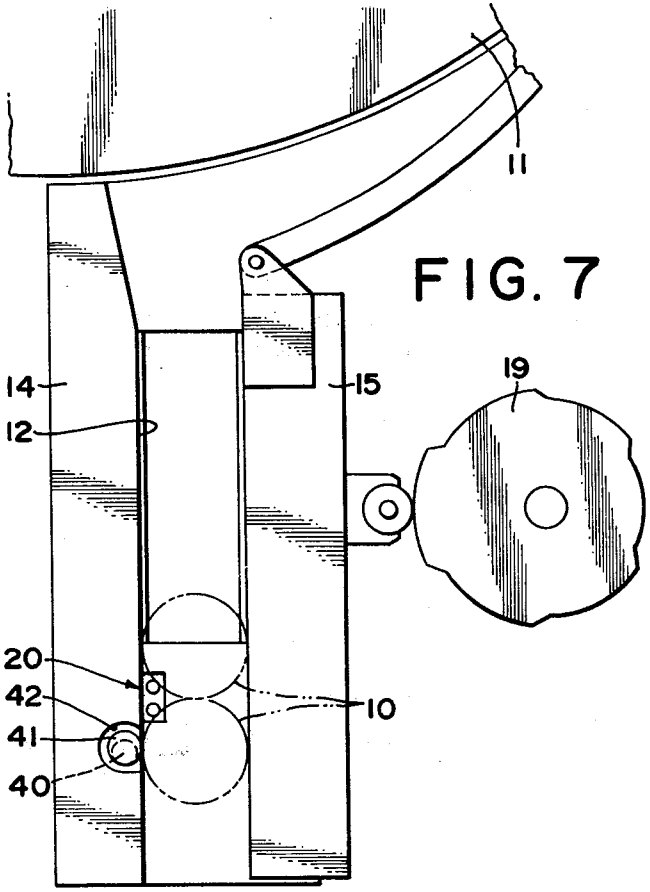
FIG. 7 is a top plan view showing a fifth embodiment of the stopper.

In FIGS. 7 and 8, there is shown a fifth embodiment of the stopper 25 wherein the stopping shaft 40 is mounted to project upwardly through an opening 42 provided in the base plate 26 and the fixed guide plate 14, in a similar manner to that of FIG. 3. The shaft 40 is provided at its top portion with an eccentric disc 41.

In the embodiment, when the eccentric disc 41 is accommodated in the opening 42 not to project into the coin path (FIG. 7), the coins can freely pass in the coin path. When the eccentric disc 41 is rotated 90° or 180° to project into the coin path (FIG. 8), the coins are stopped.

In operation for the stopper, an explanation will be made, particularly, with reference to FIGS. 1 to 3. The coins supplied on the rotary disc 11 are guided into the coin path 12 by rotation of the rotary disc 11 one after another in a continuous stream. The guided coins are sequentially transferred in the coin path by the transfer belt and then pass by the coin counting device 20. During counting operation, the shaft 30 is oriented so that the vertical surface **31*b* of the cut-out 31** is in alignment with the inner surface to cause the coins to freely pass by the stopper.

The coin counting device 20 counts the number of the coins which pass by. More particularly, the detecters 21 and 22 of the counting device 20 detect the passage of the coins and generate signals which are processed to be added to the counter, which will be described hereinafter in more detail. When the preset number of coins are counted, a count end signal is issued to energize the solenoid 32. Consequently, the shaft 30 is rotated 90° or 180° so that the top portion **31*c* of the shaft 30 is projected into the coin path 12** to stop the subsequent coins.

Thereafter, a handling end signal is issued to cause the shaft to return to its initial position by reversely rotating the shaft 30 or forwardly rotating the shaft 30 further. Then, the coin handling machine is ready for the next cycle. It should be noted that the shaft 30 is preferably rotated clockwisely in FIG. 3 so as to follow up the last passing coin, which imparts only a small shock to the subsequent coins to be stopped.

Figure 9:
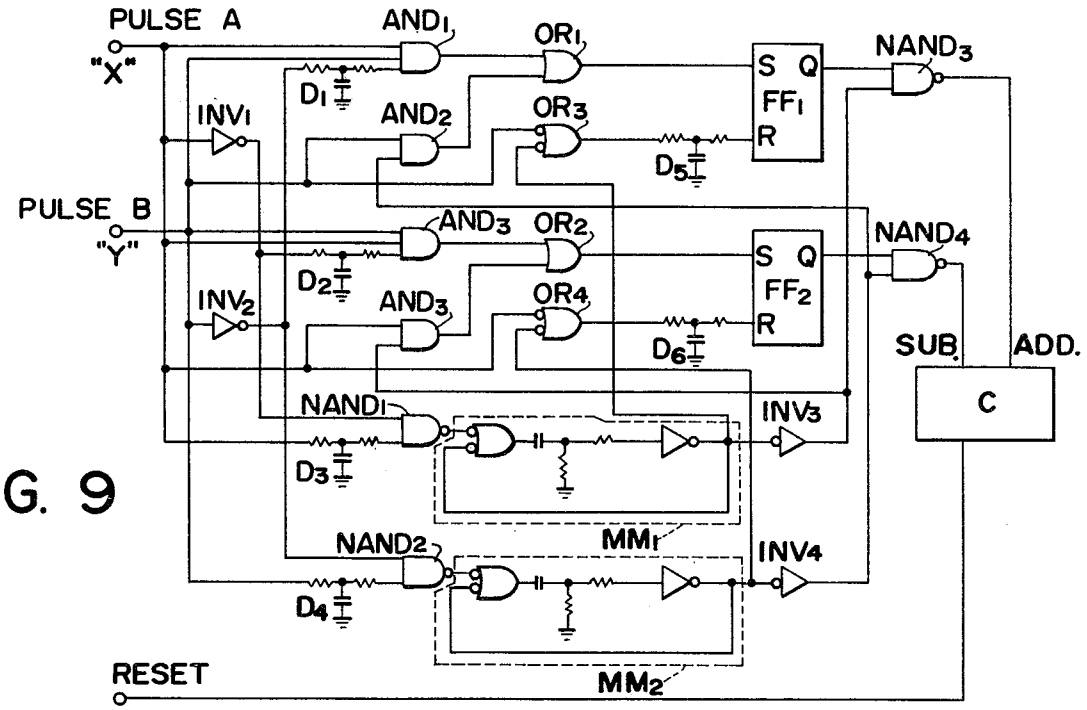
FIG. 9 is a diagram showing a circuit of one embodiment for use in the coin counting device.
Figure 10:
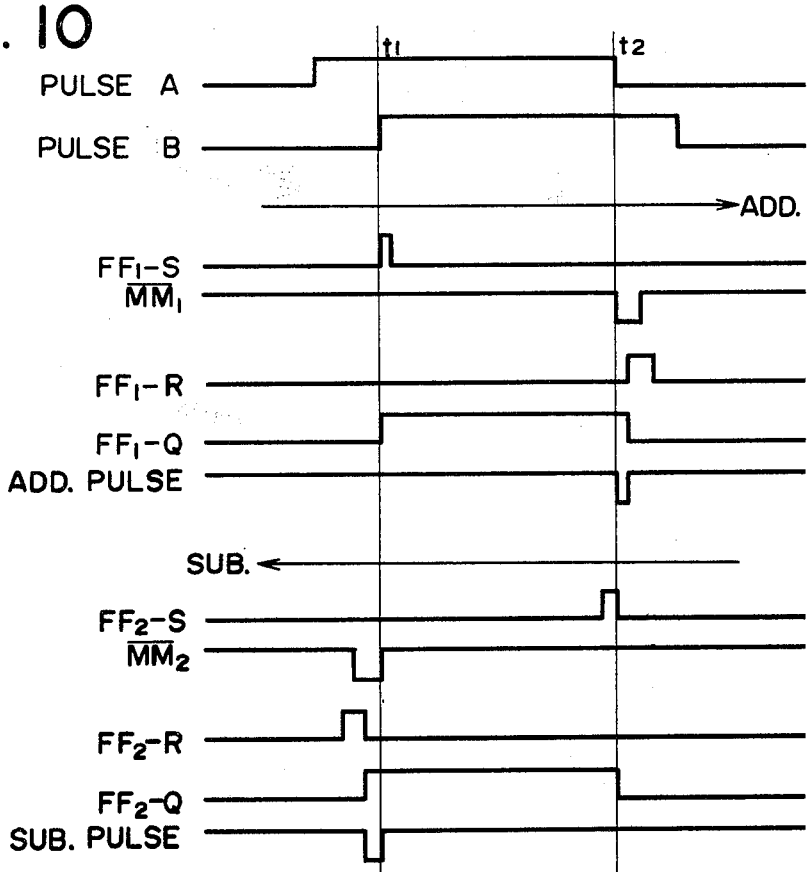
FIG. 10 is a diagram showing wave-forms of outputs of main elements of FIG. 9.
Figure 11:
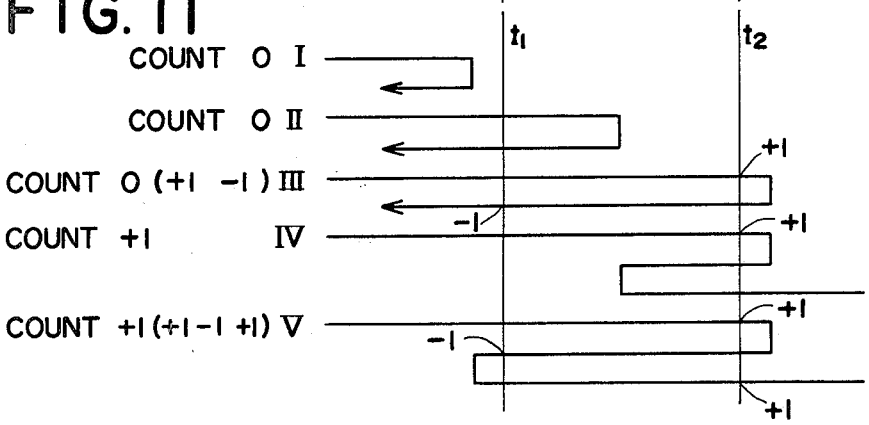
FIG. 11 is an explanatory diagram showing operation of the counter in response to the movement of coin.

Referring now to FIGS. 9 to 11, one embodiment of an electric circuit for use in the counting device 20 will be now explained. The detecters 21 and 22 receive light from the source of light 23 such as an LED before the coin reaches the detecters 21 and 22. Then, the detecters 21 and 22 are sequentially blocked from light by the coin while the coin passes the detecters, and again receive light from the source 23 after the coin has passed. The detecters 21 and 22 are electrically connected to junctions "X" and "Y," respectively. The detecter 21 generates a pulse A at the junction "X" due to the blocking of light and the detecter 22 generates a pulse B at the junction "Y" due to the blocking of light (FIG. 10).

When the coin is transferred forwardly, the pulse A first rises and then the pulse B rises at a timing $t_1$. In such a case, an L (low) level signal is issued from an inverter $INV_2$ and is delayed through a delay circuit $D_1$. During delay, a pulse $FF_1$-S for setting a flip-flop $FF_1$ is put out from an AND gate $AND_1$ through an OR gate $OR_1$.

Then, the pulse A falls at a timing $t_2$, and is delayed through a delay circuit $D_3$. During this delay, a monostable multivibrator $\overline{MM_1}$ is triggered by an H (high) level signal from the inverter $INV_1$ to issue a waveform $MM_1$ at an input of an inverter $INV_3$ or an OR gate $OR_3$.

The waveform $\overline{MM_1}$ adds a H level pulse to one of inputs of a NAND gate $NAND_3$ through the inverter $LNV_3$. On the other hand, the waveform $\overline{MM_1}$ is inverted and passed through an OR gate $OR_3$. The waveform $\overline{MM_1}$ thus passed is then delayed by a delay circuit $D_5$. The delayed pulse (waveform $FF_1$-R) is put in at a reset terminal R of the flip-flop $FF_1$. Therefore, a waveform $FF_1$-Q is put out at an output terminal Q of the flip-flop $FF_1$. Consequently, a NAND gate $NAND_3$ issues an add pulse and then a counter C is counted up by one.

When the coins are counted by the counter C and the number of the counted coins reaches the preset number, as aforementioned, the count end signal is issued to stop the subsequent coins by the shaft 30. The leading coin of the coins which have been stopped covers the detecters and therefore, the detecters are blocked from light. At this time the leading coin is located in a position corresponding to the time between the timings $t_1$ and $t_2$, and thereby no odd count is made.

When the coin handling is again started the coin thus stopped passes by the detecters and the counter C counts up.

In case where the coin which has once passed by the detecters 21 and 22 reversely passes by the detecters by the backward or reverse movement for some reasons, the pulse B first rises and then the pulse A rises to set a flip-flop $FF_2$. In a similar manner as described above, a subtraction pulse is put in the counter C in which subtraction is made.

FIG. 11 shows some cases where the coin is reversely moved. In case of I, the coin is reversely moved before the coin reaches the timing $t_1$. In this case, the counter is not counted up. In case of II, the coin is reversely moved before it reaches the timing $t_2$. In such a case, the counter is also not counted up. In case of III, the coin is reversely moved after the timing $t_2$ has lapsed. In this case, although the counter counts up, the counter counts down again since the coin is reversely moved. Consequently no odd count is made. Further, in case of IV, the coin is reversely moved after the timing $t_2$ has lapsed and then forwardly transferred before the coin reaches the timing $t_1$. In this case, after one add count is made, no subtraction count is made. Therefore, the counter counts up by one. In case of V, the coin is reversely moved after the timing $t_2$ has lapsed and then forwardly transferred after the timing $t_1$ lapses. In this case, one add count is made, then one subtraction count is made and finally another add count is made. Therefore, the counter counts up by one.

From the above description, it should be noted that by the provisions of two detecters, the counter is constructed so that add count or subtraction count can be made in accordance with the direction of movement of coin, and therefore no malfunction is made.

Figure 12:
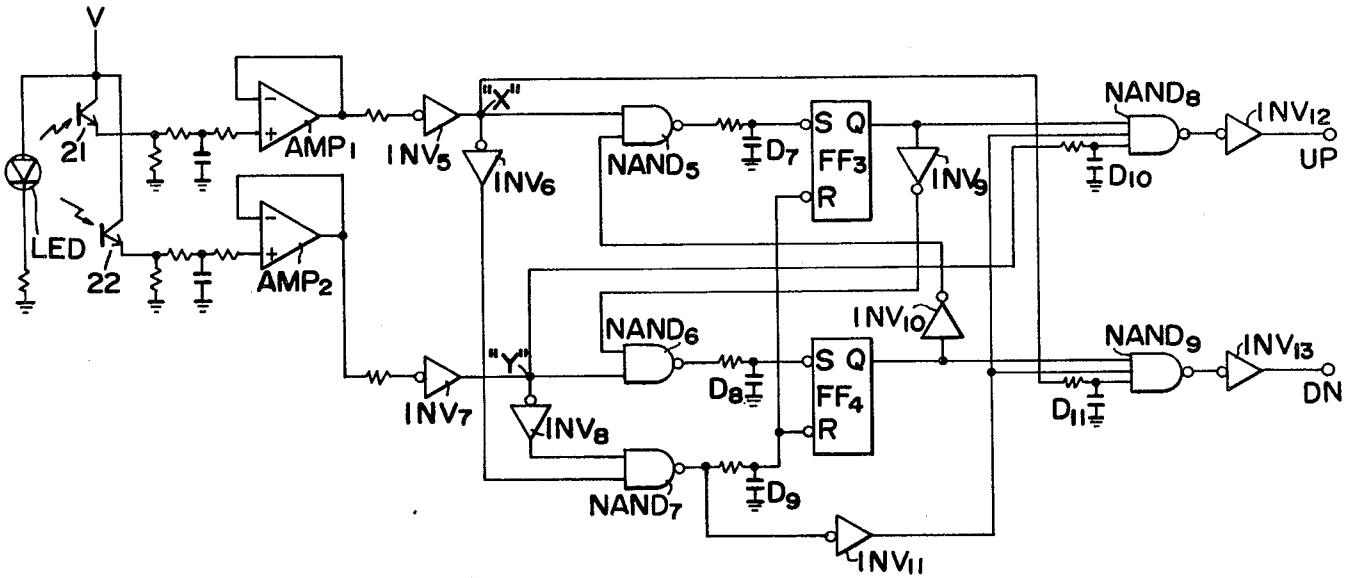
FIG. 12 is a diagram showing a circuit of a second embodiment for use in the coin counting device.
Figure 13:
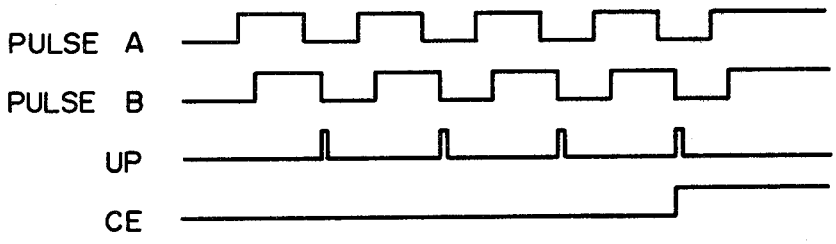
FIG. 13 is a diagram showing wave-forms of outputs of main elements of FIG. 12.

In FIGS. 12 and 13, another embodiment of a circuit for use in the coin counting device is shown. Since the circuit shown in FIG. 12 is similar in function to that of FIG. 9, only a brief explanation will be made. Two pulses A and B which are the same as those of FIG. 10 appear at junctions "X" and "Y." In this embodiment, two flip-flops $FF_3$ and $FF_4$ memorize the direction of movement of the coins. That is, in the forward movement of the coins, the flip-flop $FF_3$ is made active or set and the flip-flop $FF_4$ is made inactive or reset, and vice versa. In the embodiment, it should be noted that an add count signal is issued after the fall of the pulse B. The count end signal CE is issued when the number of counted coins reaches the preset number and the shaft 30 is actuated, as aforementioned, to stop the subsequent coins.

Figure 14:
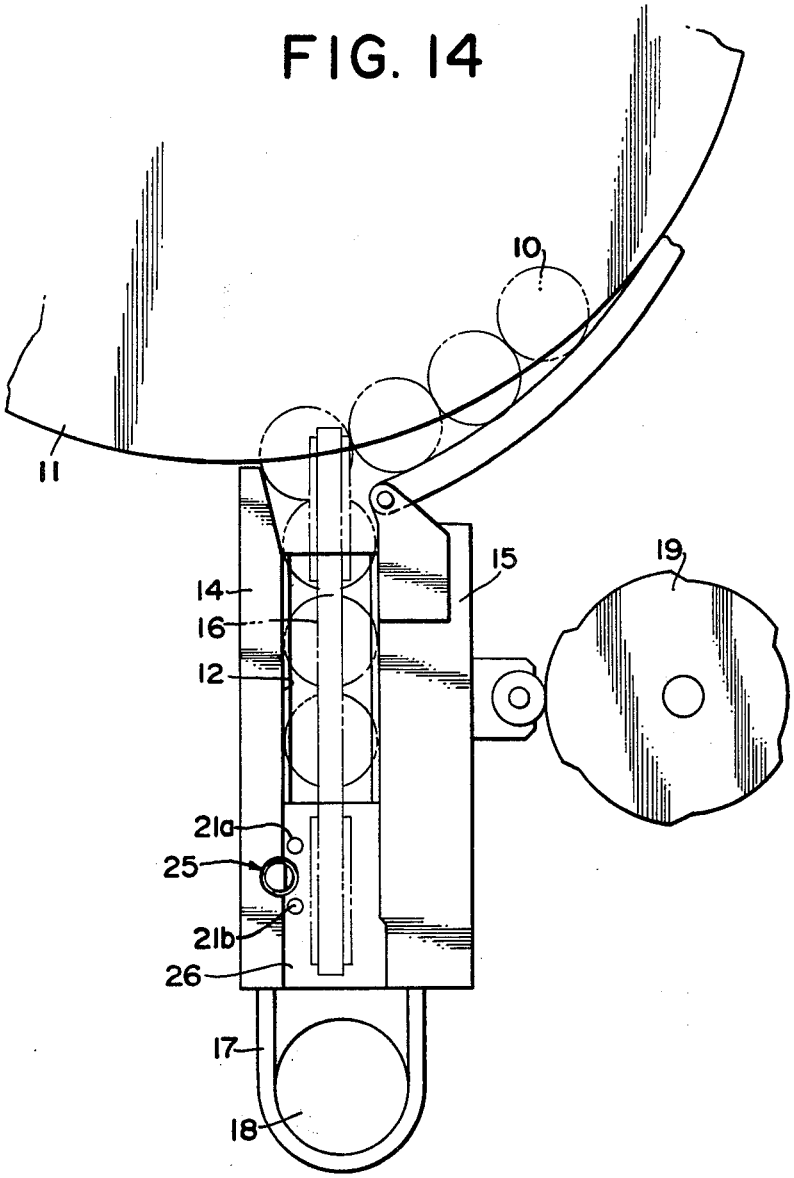
FIG. 14 is a top plan view showing another embodiment of the coin counting device.

Referring now to FIG. 14, there is shown another embodiment of the coin counting device in which one detecter **21*a* is provided upstream of the stopper 25 while the other detecter 21*b* is provided downstream of the stopper. In this case, only the detecter 21*a* is used to make a counting operation and the other detecter 21*b* may be used to detect the presence of the coin which has passed through the stopper, but remains on the base plate 26**, or may not be used.

Figure 15:
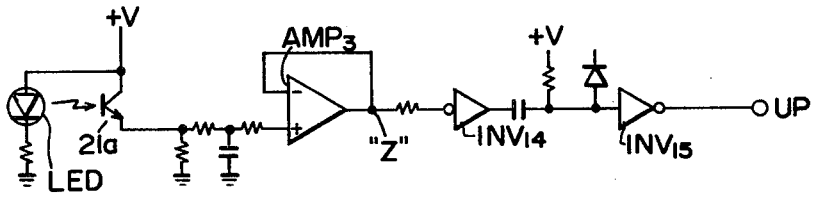
FIG. 15 is a diagram showing a circuit of a third embodiment for use in the coin counting device.
Figure 16:
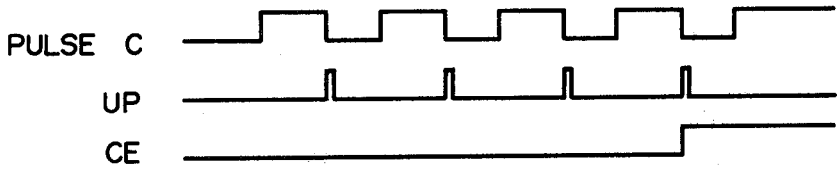
FIG. 16 is a diagram showing wave-forms of outputs of main elements of FIG. 15.

In FIGS. 15 and 16, there are shown a circuit and a diagram of waveforms which are embodied to be used for the counting device 20 of FIG. 14. The pulse C which is generated by the detecter **21*a*** appears at junction "Z." In the circuit, the counter can only make an add count. Therefore, it should be noted that the circuit must be used when the coins are transferred forwardly only.

What is claimed is:

1. A coin counting and stopping apparatus for use in a coin handling machine wherein coins transferred in a coin path are counted one after another and stopped when a preset number of coins is counted which comprises:

at least one detector provided in the coin path for detecting the passage of the coins to generate signals;

a stopper rotatably mounted downstream of said detector and including a portion to be projected into the coin path so as to stop the coins when the stopper is rotated; and means for rotating the stopper when the signals indicate that the preset number of coins are counted, said stopper being disposed so that its axis is perpendicular to the coin path and comprising a shaft formed at the top portion thereof with a cut-out.

2. A coin counting and stopping apparatus for use in a coin handling machine wherein coins transferred in a coin path are counted one after another and stopped when a preset number of coins is counted which comprises:

at least one detector provided in the coin path for detecting the passage of the coins to generate signals;

a stopper rotatably mounted downstream of said detector and including a portion to be projected into the coin path so as to stop the coins when the stopper is rotated; and means for rotating the stopper when the signals indicate that the preset number of coins are counted, said stopper being disposed so that its axis is perpendicular to the coin path and comprising a shaft provided at the top portion thereof with an eccentric disc.

3. A coin counting and stopping apparatus for use in a coin handling machine wherein coins transferred in a coin path are counted one after another and stopped when a preset number of coins is counted which comprises:

at least one detector provided in the coin path for detecting the passage of the coins to generate signals;

a stopper rotatably mounted downstream of said detector and including a portion to be projected into the coin path so as to stop the coins when the stopper is rotated; and means for rotating the stopper when the signals indicate that the preset number of coins are counted, said stopper being disposed so that its axis is perpendicular to the coin path and comprising a shaft formed at the top portion thereof with a groove.

4. A coin counting and stopping apparatus for use in a coin handling machine having two guide plates with inner surfaces defining a coin path, coins transferred in the coin path being counted one after another and stopped when a preset number of coins is counted, which comprises:

two detectors provided in the coin path for detecting the passage of the coins to generate signals, said two detectors being disposed so that the detectors are concurrently included within a generally triangular space which is defined by the inner surface of one of the guide plates forming the coin path and the peripheral portions of two adjacent coins when the coins are transferred in abutting relationship with each other and so that one detector is first blocked by a specific coin from light and the other detector is then blocked by the specific coin from light while the one detector is first released from the block of the specific coin and then the other detector is released from the block of the specific coin, a stopper rotatably mounted downstream of said detectors and including a portion to be projected into the coin path so as to stop the coins when the stopper is rotated, and means for rotating the stopper when the signals indicate that the preset number of coins are counted.

5. An apparatus as set forth in claim 4 further including an electric circuit comprising means for issuing an add count signal, means for issuing a subtraction count signal, and a counter for handling said add count signal and said subtraction count signal in accordance with the signals generated by said detectors.

6. An apparatus as set forth in claim 5 wherein said counter issues a count end signal used to actuate said stopper when the preset number of coins are counted.

* * * * *